US010633064B1

(12) United States Patent
Oldham

(10) Patent No.: US 10,633,064 B1
(45) Date of Patent: Apr. 28, 2020

(54) FOLDING, HARD SIDED BOAT

(71) Applicant: Don A. Oldham, Spanish Fork, UT (US)

(72) Inventor: Don A. Oldham, Spanish Fork, UT (US)

( * ) Notice: Subject to any disclaimer, the term of this patent is extended or adjusted under 35 U.S.C. 154(b) by 0 days.

(21) Appl. No.: 16/597,312

(22) Filed: Oct. 9, 2019

Related U.S. Application Data

(60) Provisional application No. 62/744,986, filed on Oct. 12, 2018.

(51) Int. Cl.
*B63B 71/00* (2020.01)
*B63B 1/12* (2006.01)
*B63B 85/00* (2020.01)

(52) U.S. Cl.
CPC ..... *B63B 71/00* (2020.01); *B63B 1/125* (2013.01); *B63B 85/00* (2020.01)

(58) Field of Classification Search
CPC ..... B63B 9/00; B63B 2009/006; B63B 1/125; B63B 71/00
USPC ..... 114/353
See application file for complete search history.

(56) References Cited

U.S. PATENT DOCUMENTS 1,462,800 A * 7/1923 Clemmer ..... B63B 7/04 114/353
2,916,748 A * 12/1959 Stahmer ..... B63B 7/02 114/352
3,594,834 A 7/1971 Steensen
5,868,097 A * 2/1999 Spickelmire ..... B63B 7/04 114/353
6,948,443 B1 * 9/2005 Kopylov ..... B63B 7/04 114/352
2011/0023769 A1 * 2/2011 Poston ..... B63B 7/04 114/353
2018/0099734 A1 * 4/2018 Schibli ..... B63B 35/7943

OTHER PUBLICATIONS

Transporter: From Box to a Boat, www.youtube.com/watch?v=PSM0v8x4kUw, published Feb. 1, 2013, pp. 1-5.
Transporter Boat: Portable, Storable, Functional, www.youtube.corn/watch?v=iw-6dKU3Pkc, published Feb. 4, 2013, pp. 1-6.
ATV floats on small boat, www.youtube.com/watch?v=TSRACLL3dl8&t=13s, published Mar. 29, 2013, pp. 1-6.

* cited by examiner

*Primary Examiner* — Stephen P Avila
(74) *Attorney, Agent, or Firm* — Warren M. Pate; Pate Peterson, PLLC

(57) ABSTRACT

A method of stowing a boat is disclosed. The boat may include three hull segments, namely a first hull segment, a second hull segment, and a third hull segment. The third hull segment may form the bow of the boat. The method may include separating the third hull segment from the other hull segments. Thereafter, one of the first hull segment and the second hull segment may be pivoted and inverted over onto the other such that the first hull segment and the second hull segment collectively form a clamshell enclosure. The relative sizing of the first, second, and third hull segments may be such that the third hull segment may be stored within an interior volume of the enclosure.

20 Claims, 10 Drawing Sheets

FOLDING, HARD SIDED BOAT

RELATED APPLICATIONS

This application claims the benefit of U.S. Provisional Patent Application Ser. No. 62/744,986 filed Oct. 12, 2018, which is hereby incorporated by reference.

BACKGROUND

Field of the Invention

This invention relates to boats and, more particularly, to novel systems and methods for boats that are highly portable.

Background Art

Boats can be bulky and difficult to transport and store. For example, boats big enough to carry several passengers typically need to be transported to and from the water on a trailer. Accordingly, users of such boats need to have a tow vehicle, be comfortable with pulling and backing a trailer, and have space to store the boat and trailer when the boat is not in use. What is needed is a boat that is more easily transported and stored.

BRIEF SUMMARY OF THE INVENTION

In view of the foregoing, in accordance with the invention as embodied and broadly described herein, a method and apparatus are disclosed in one embodiment of the present invention as including a foldable boat. A main body of a boat may comprise multiple segments. Such segments may include two passenger compartments and a removable bow. The two passenger compartments may each comprise a forward bulkhead and a rearward bulkhead. The bulkheads may match the height of the side walls of the corresponding compartments and prevent water from entering the passenger compartments.

In selected embodiments, the two passenger compartments may be oriented with respect to one another so that a forward bulkhead of a rearward passenger compartment matches and abuts a rearward bulkhead of a forward passenger compartment. The rearward bulkhead of the rearward passenger compartment may form the transom of the boat. The forward bulkhead of the forward passenger compartment may match and abut a rearward facing surface of a bow segment.

To stow the boat, the bow segment may be separated from the two passenger compartments. Thereafter, one of the passenger compartments may be pivoted and inverted over onto the other such that the passenger compartments collectively form a clamshell enclosure. The relative sizing of the various segments may be such that the bow segment may be stored within an interior volume of the enclosure formed when one passenger compartment is inverted over onto the other.

A boat in accordance with the present invention may include an outrigger system or frame that extends laterally to engage one or more pontoons for stability and/or additional flotation. The frame may be removable and/or collapsible so that it may be removed and/or stowed when a boat is folded or stowed. In selected embodiments, each pontoon may be formed of forward and rearward segments. In certain embodiments, the forward and rearward segments may nest one within the other so that the pontoons may also be stored within an interior volume of the enclosure formed when one passenger compartment is inverted over onto the other.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
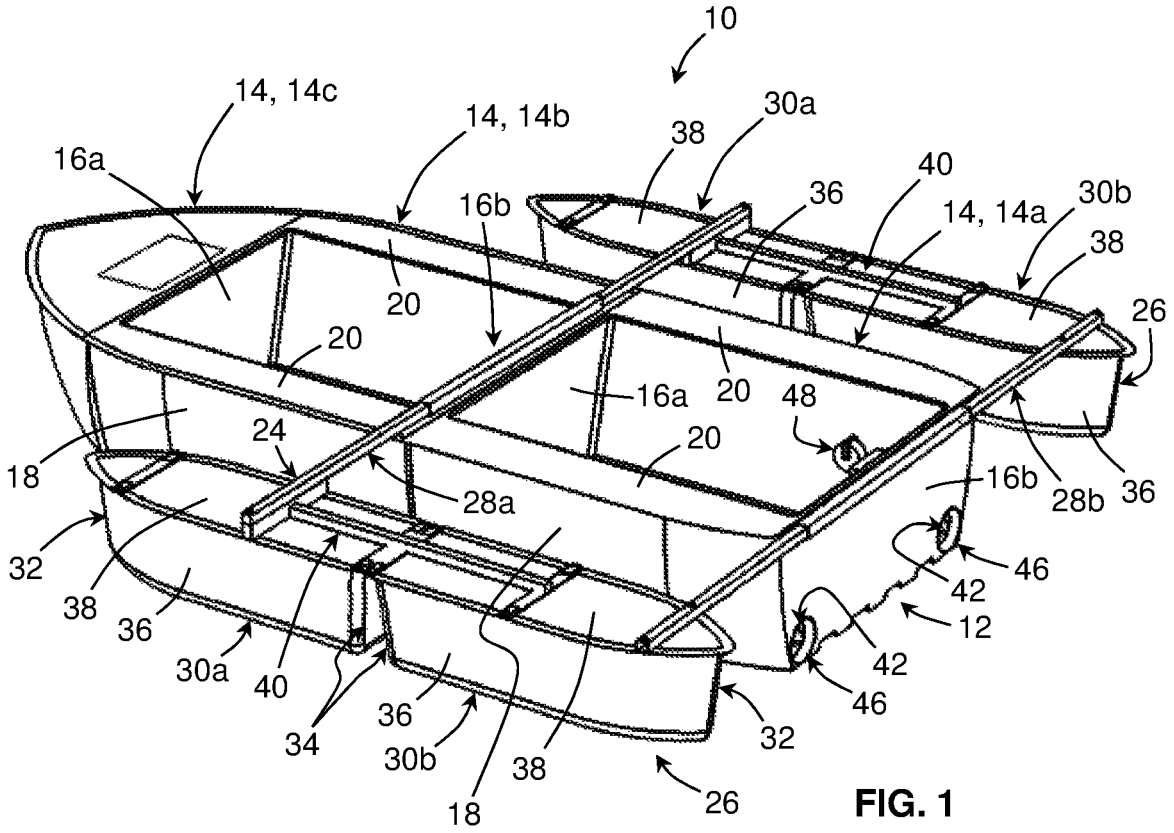
FIG. 1 is a perspective view of one embodiment of a boat in accordance with the present invention in a deployed configuration.
Figure 2:
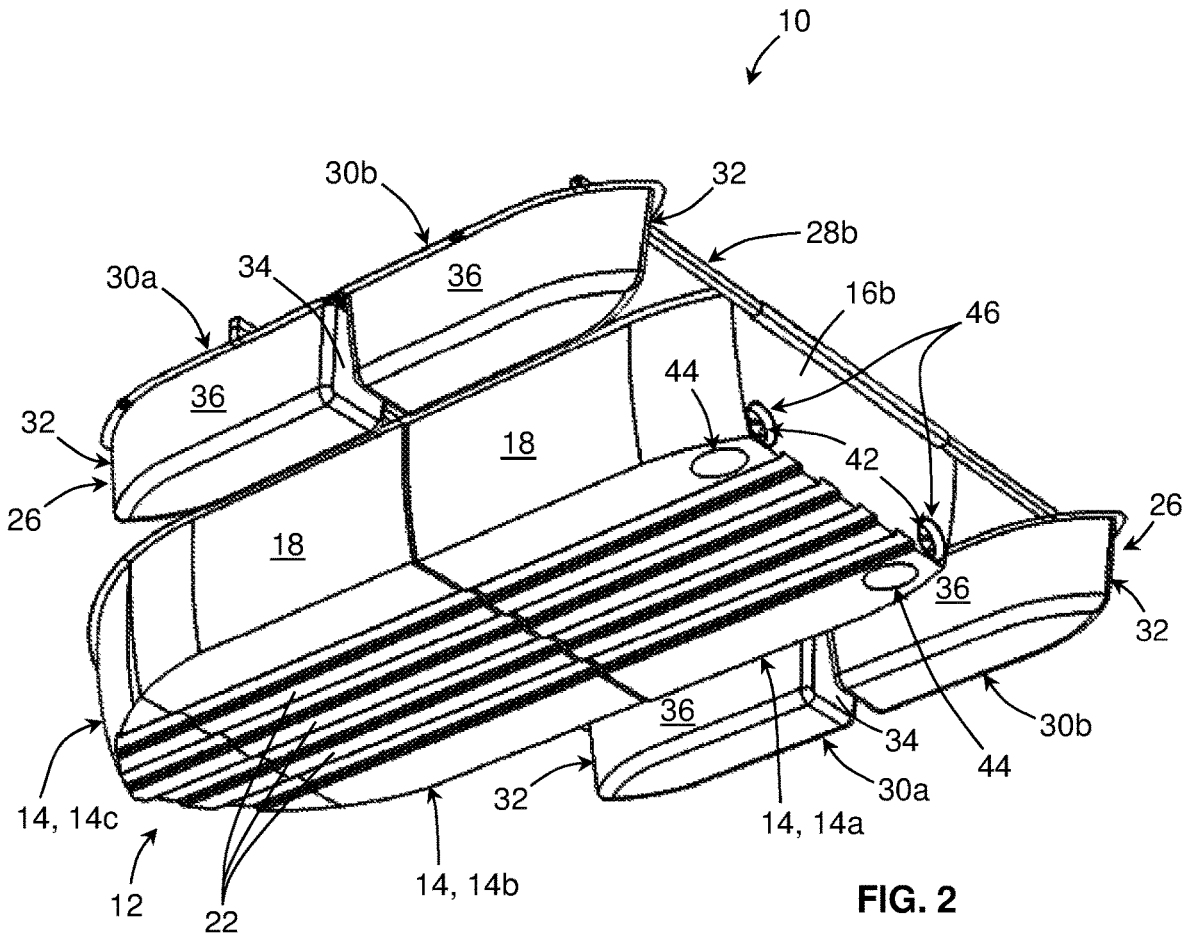
FIG. 2 is another perspective view of the boat of FIG. 1 in the deployed configuration.
Figure 3:
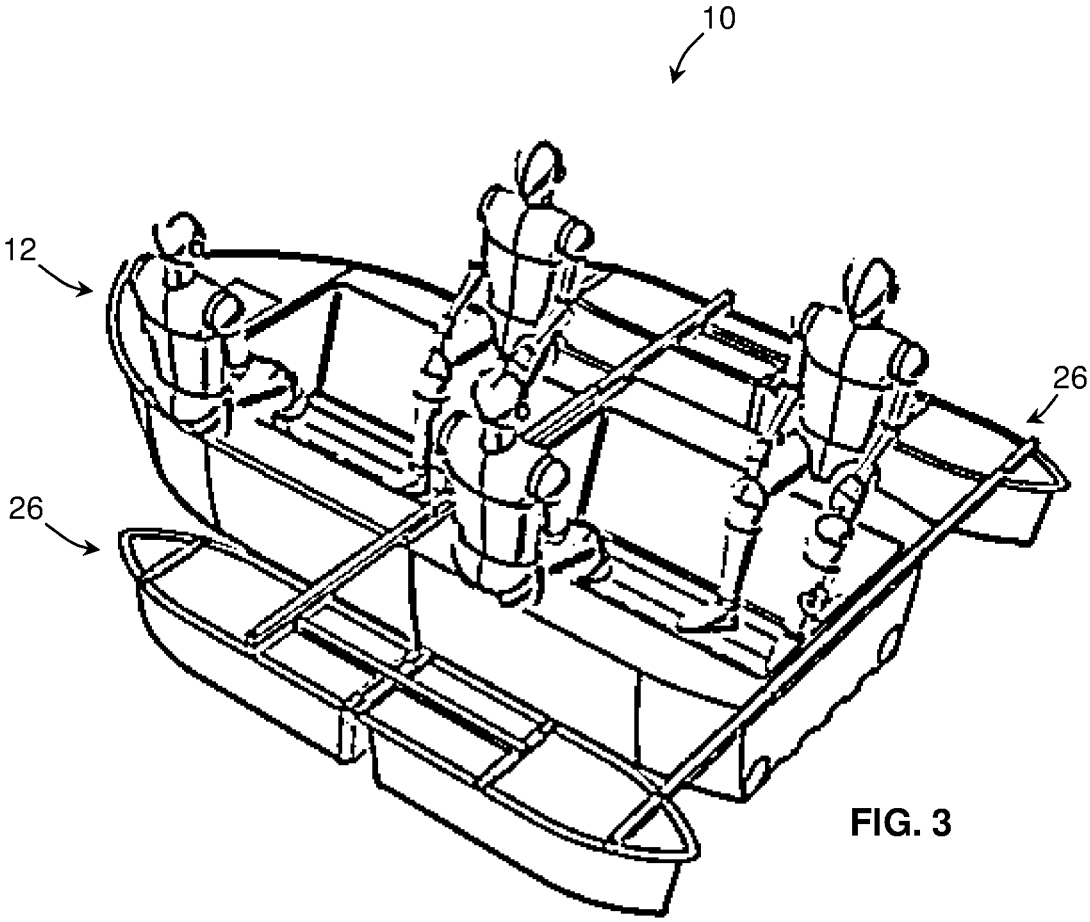
FIG. 3 is a perspective view of the boat of FIG. 1 in a deployed configuration and carrying four passengers.
Figure 4:
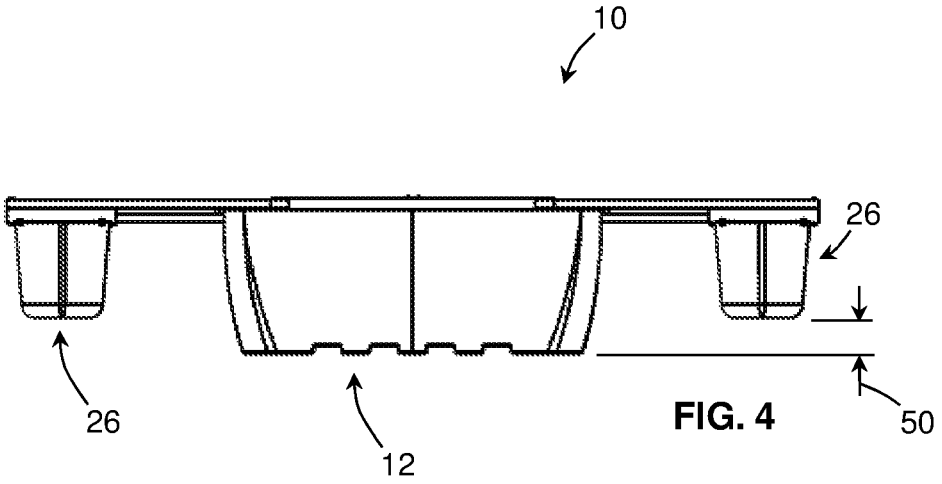
FIG. 4 is a front view of the boat of FIG. 1 in the deployed configuration.
Figure 5:
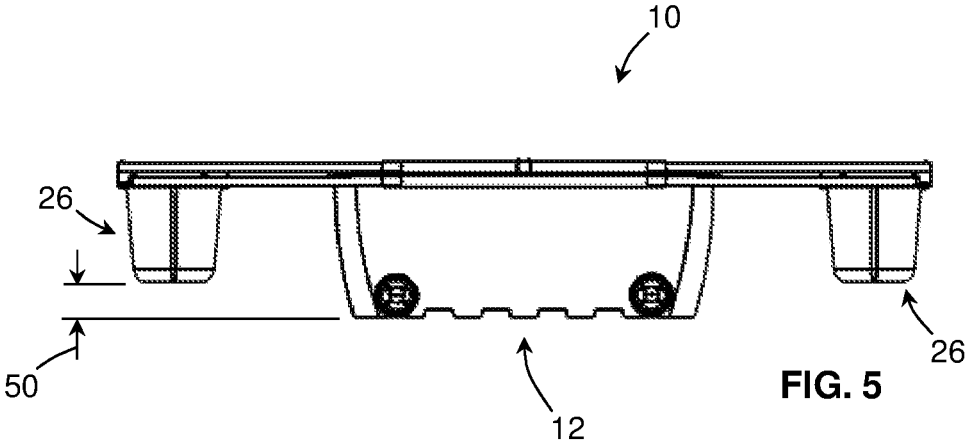
FIG. 5 is a back view of the boat of FIG. 1 in the deployed configuration.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1-5, in selected embodiments, a boat 10 in accordance with the present invention may be foldable. In an unfolded or deployed configuration, a boat 10 may be suitable for supporting one or more persons as they navigate, fish, enjoy, or otherwise float a body of water. A main body 12 of a boat 10 may comprise multiple segments 14. In certain embodiments, such segments 14 may include two passenger compartments 14*a*, 14*b* and a removable bow 14*c*.

In selected embodiments, the two passenger compartments 14*a*, 14*b* may each comprise a forward bulkhead 16*a* and a rearward bulkhead 16*b*. The bulkheads 16*a*, 16*b* may match the height of the side walls 18 of the corresponding compartments 14*a*, 14*b*. Accordingly, the bulkheads 16*a*, 16*b* may prevent water from entering the corresponding passenger compartments 14*a*, 14*b*.

In certain embodiments, the two passenger compartments 14*a*, 14*b* may be configured and oriented so as to be mirror images of one another. Accordingly, the two passenger compartments 14*a*, 14*b* may have the same dimensions, be formed in the same molds, or the like.

In selected embodiments, the two passenger compartments 14*a*, 14*b* may be oriented with respect to one another so that a forward bulkhead 16*a* of a rearward passenger compartment 14*a* matches and abuts a rearward bulkhead 16*b* of a forward passenger compartment 14*b*. Accordingly, a rearward bulkhead 16*b* of the rearward passenger compartment 14*a* may match a forward bulkhead 16*a* of the forward passenger compartment 14*b*. The rearward bulkhead 16*b* of the rearward passenger compartment 14*a* may form the transom of the boat 10. The forward bulkhead 16*a* of the forward passenger compartment 14*b* may match and abut a rearward facing surface of a bow segment 14*c*.

In certain embodiments, the two passenger compartments 14*a*, 14*b* may be connected via one or more hinges. Additionally, in an unfolded or deployed configuration, the passenger compartments 14*a*, 14*b* may be secured to one another so as to prevent pivoting about the one or more hinges. Such securement may include one or more fasteners (e.g., threaded fasteners or bolts) extending to connect or lock a forward bulkhead 16*a* of one passenger compartment 14*a* to a rearward bulkhead 16*b* of the other passenger compartment 14*b*.

A bow segment 14*c* of a boat 10 may be mounted to an adjacent passenger compartment 14*b* using one or more hinges. In selected embodiments, such hinges may enable a bow segment 14*c* to pivot about an axis that is parallel to the axis of rotation between the two passenger compartments 14*a*, 14*b*. Additionally, the hinges may enable a bow segment 14*c* to slide laterally (e.g., to the port or starboard side of the boat 10) in order to effect a disengagement thereof. Accordingly, by sliding the bow segment 14*c* to one side or the other, it may be separated from the rest of the boat 10.

Additionally, in an unfolded or deployed configuration, a bow segment 14*c* may be secured to an adjacent passenger compartment 14*b* so as to prevent pivoting about the one or more hinges and/or lateral sliding. Such securement may include one or more fasteners (e.g., threaded fasteners or bolts) extending to connect or lock a forward bulkhead 16*a* of the passenger compartment 14*b* to a rearward facing surface of the bow segment 14*c*.

A boat 10 in a deployed configuration may provide seating for up to about four adults. In certain embodiments, such seating may be side-wall seating. That is, the top surfaces 20 of the side walls 18 of the various passenger compartments 14*a*, 14*b* may be sufficiently large, flat, or the like to enable one or more adults to sit thereon. With side-wall seating, the passengers may be better positioned to interact and communicate. All passengers may be able to see and communicate with each other with at most a ninety degree turn of the head. This contrasts to boats with bench seating, where rear passengers look at the back of the heads of front passengers and communication is more difficult.

In selected embodiments, a main body 12 of a boat 10 in accordance with the present invention may have a flat bottom. A flat bottom may facilitate launching in shallow water. In certain embodiments, a flat bottom of a boat 10 may have a corrugated pattern formed therein. The corrugations 22 may extend from bow to stern. Accordingly, the corrugations 22 may be aligned across the various segments 14 of a main body 12. The corrugations 22 may impart directional stability to the boat 10 without the need for a v-shaped keel. The corrugations 22 may also impart structural strength to the floor of a main body 12 of a boat 10.

A boat 10 in accordance with the present invention may include an outrigger system 24 or frame 24 that extends laterally to engage one or more pontoons 26 (e.g., two pontoons 26, one on each side of a main body 12) for stability and/or additional flotation. The frame 24 may be removable and/or collapsible so that it may be removed and/or stowed when a boat 10 is folded or stowed. For example, a frame 24 may comprise front and rear outriggers 28*a*, 28*b* that each telescope. The front and rear outriggers 28*a*, 28*b* may be removed from the boat using push-in snap connectors, removing one or more connecting bolts, or the like or a combination or sub-combination thereof.

In selected embodiments, each of the front and rear outriggers 28*a*, 28*b* may comprise one or more pieces of structural material (e.g., one or more segments of metal, carbon fiber, or fiberglass tubing or the like) that collectively form a substantially rigid element extending from one pontoon 26 across a main body 12 to the other pontoon 26. Thus, buoyancy loads or forces corresponding to the pontoons 26 may be handled or resolved by the outriggers 28*a*, 28*b* and not the main body 12. This may enable the main body 12 to be formed of fewer, lighter, and/or less expensive materials.

In selected embodiments, each pontoon 26 in accordance with the present invention may be formed of forward and rearward segments 30*a*, 30*b*. In certain embodiments, the forward and rearward segments 30*a*, 30*b* may be configured and oriented so as to be mirror images of one another. Accordingly, the forward and rearward segments 30*a*, 30*b* may have the same dimensions, be formed in the same molds, or the like.

In selected embodiments, the forward and rearward segments 30*a*, 30*b* may each comprise a pointed end 32 and a flat end 34. The forward and rearward segments 30*a*, 30*b* may be oriented with respect to one another so that a flat end 34 of a forward segment 30*a* is adjacent and aligned with a flat end 34 of a rearward segment 30*b*. Accordingly, a pointed end 32 of a forward segment 30*a* may form the bow of a pontoon 26, while a pointed end 32 of a rearward segment 30*b* may form the stern of the pontoon 26.

In certain embodiments, each of the forward and rear segments 30*a*, 30*b* may comprise a lower portion 36 and a cover 38. A lower portion 36 may be or comprise a hollow shell (e.g., a shell vacuum formed of ABS or other suitable polymeric material). A cover 38 (e.g., a sheet of ABS or other suitable polymeric material) may block water from entering and/or filling the lower portion 36. A cover 38 may have a plurality of slide on, clip-style connectors that enable or support a rapid and convenient securement and removal of the cover 38 with respect to a corresponding lower portion 36.

When a boat 10 is deployed, the forward and rearward segments 30*a*, 30*b* of each pontoon 26 may be connected via a pontoon frame 40. A pontoon frame 40 may hold the forward and rearward segments 30*a*, 30*b* together and aligned in a fixed relationship with respect to one another. Accordingly, a pontoon frame 40 may enable the forward and rearward segments 30*a*, 30*b* to collectively form a single pontoon 26.

A boat 10 may include a built-in propulsion mechanism 42. In selected embodiments, a boat 10 may include one or more thrusters 42 (e.g., one or more electrically powered impellers running off of one or more batteries carried on-board a boat 10) built into a rear passenger compartment 14*a*. Each thruster 42 may be positioned within a duct that extends from or connects an intake aperture 44 in the bottom of the compartment 14*a* to an exit aperture 46 in the back of the compartment 14*a*. Each thruster 42 may, therefore, may pull water up through a corresponding intake aperture 44 and push it out a corresponding exit aperture 46.

The thrusters 42 may work in both forward and reverse. Accordingly, in reverse, each thruster 42 may pull water in through the corresponding exit aperture 46 and push it out the corresponding intake aperture 44. In selected embodiments, a thruster control system 48 may include dual throttles to enable turning using differentials in and/or opposing thrust from dual thrusters 42.

In selected embodiments, one or more pontoons 26 may be mounted higher than a main body 12. Thus, the main body 12 may contact the ground while the pontoons 26 are spaced above the ground. This differential 50 in height may make it easier to assemble the pontoons 26, launch the boat 10, or the like. Alternatively, or in addition thereto, this differential 50 in height may ensure the main body 12 is sufficiently submerged for one or more thrusters 42 to function properly even when a boat 10 is lightly loaded (e.g., carries only one passenger). That is, the differential 50 in height may be calculated so that the pontoons 26 only significantly engage the water after a single passenger creates the initial displacement required to fully submerge the thrusters 42. Thereafter, as more weight is added to a boat 10, the pontoons 26 may enter the water to provide additional displacement and stability as needed.

Figure 6:
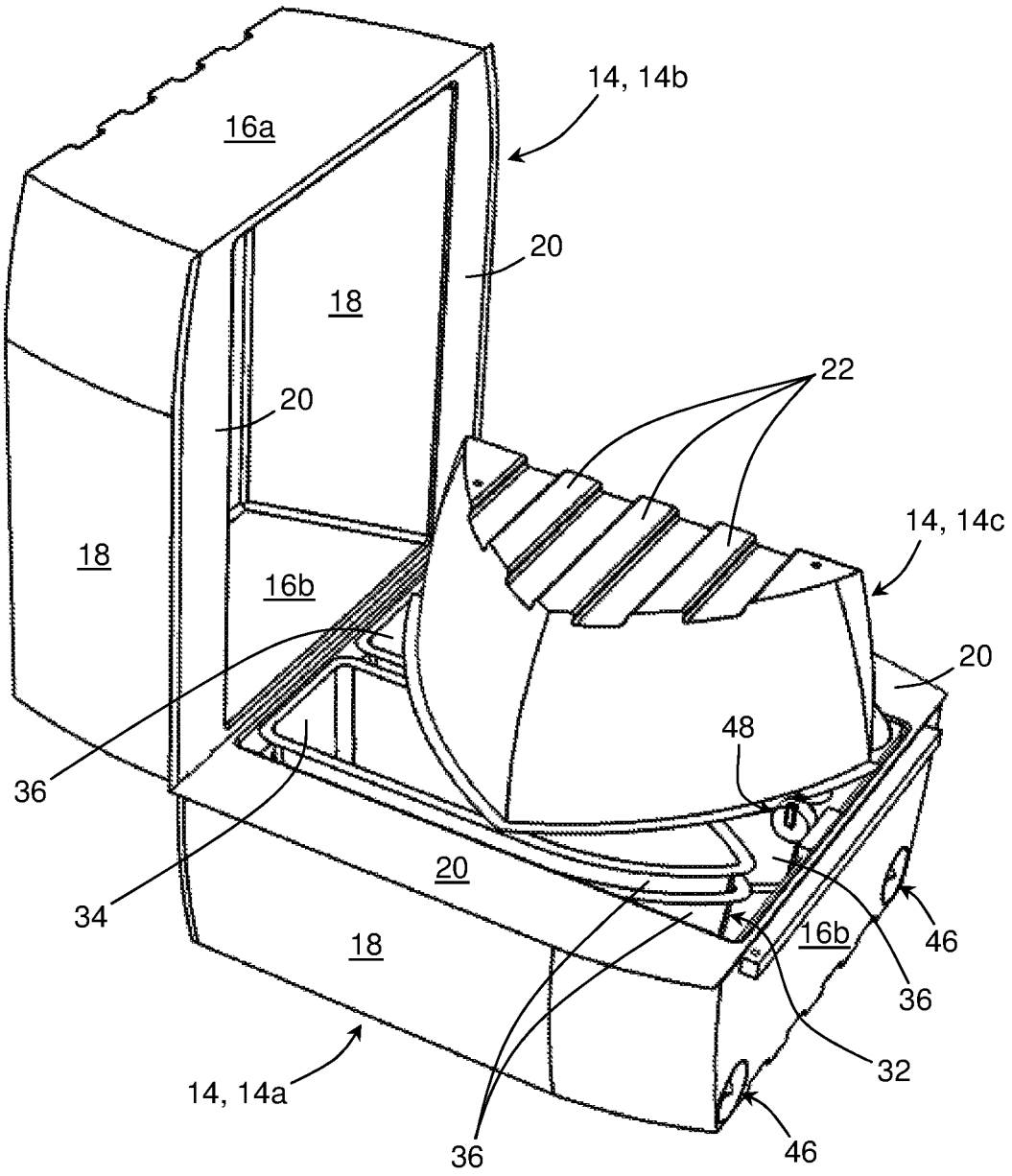
FIG. 6 is a perspective view of the boat of FIG. 1 in a partially stowed configuration.
Figure 7:
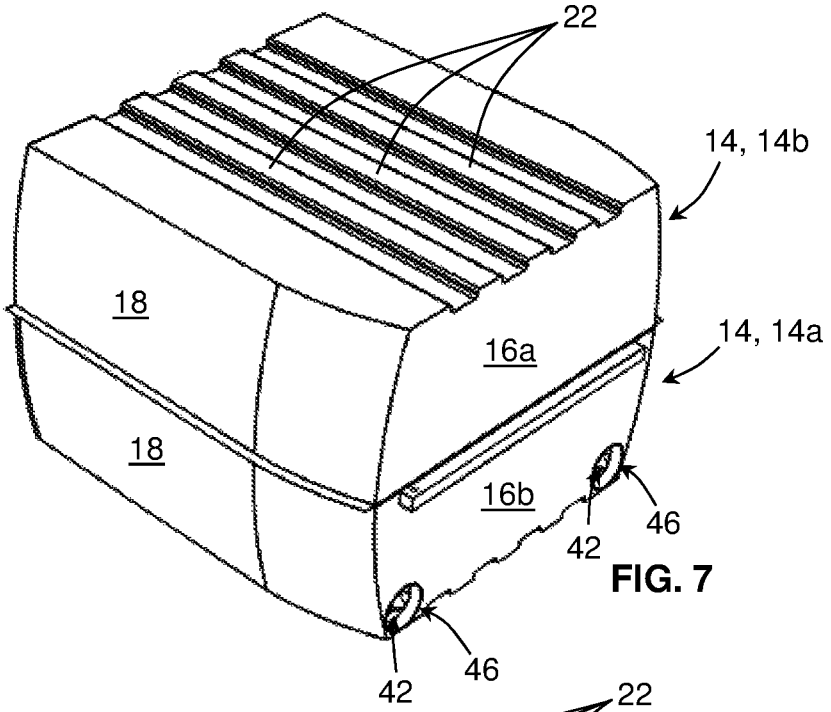
FIG. 7 is a perspective view of the boat of FIG. 1 in a fully stowed configuration.
Figure 8:
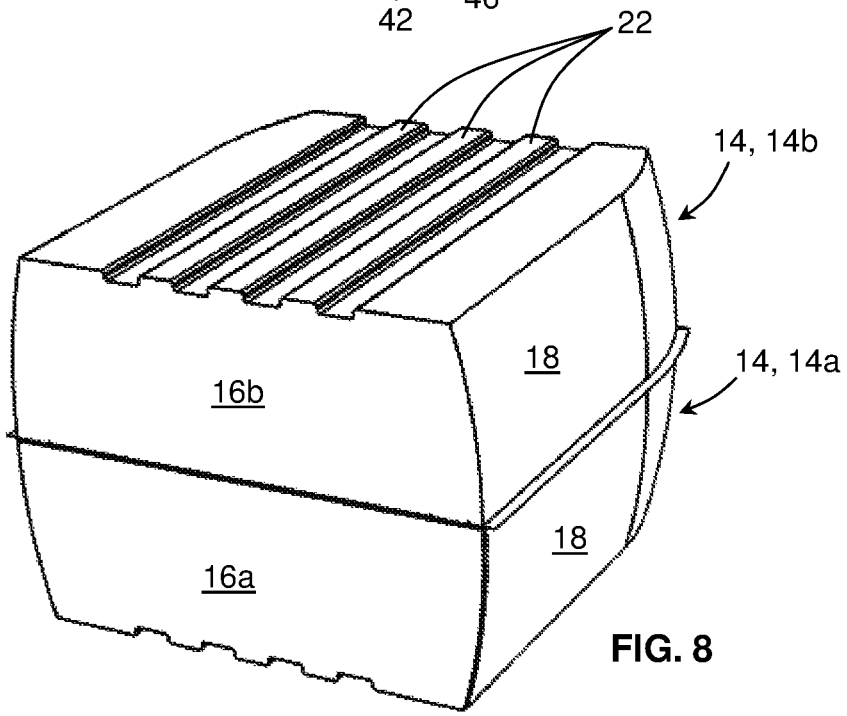
FIG. 8 is another perspective view of the boat of FIG. 1 in a fully stowed configuration.

Referring to FIGS. 6-8, in a folded or stowed configuration, a boat 10 may be readily portable. To transition from a deployed configuration to a folded or stowed configuration, the pontoons 26 may be disconnected from the frame 22. The forward and rearward segments 30*a*, 30*b* may be separated from the corresponding pontoon frames 40. The covers 38 may be removed from the lower portions 36. Two or more of the lower portions 36 may be nested together and then placed in the interior of the rearward passenger compartment 14*a* together with the covers 38, pontoon frames 40, one or more components of an outrigger system 22 or frame 22 (e.g., one or more components of a forward and/or rearward outrigger 28*a*. 28*b*), or the like or a combination of sub-combination thereof. The bow 14*c* may be removed and placed over the nested pontoons segments 30*a*, 30*b*.

As discussed hereinabove, the two passenger compartments 14*a*, 14*b* may be connected together via one or more hinges. Accordingly, a forward passenger compartment 14*b* may be pivoted over the top of the rearward passenger compartment 14*a*. That is, the forward passenger compartment 14*b* may invert as it pivots over the rearward passenger compartment 14*a* in a clamshell fashion. Thus, the bow 14*c*, pontoon segments 30*a*, 30*b*, and pieces of the various frames 24, 40 may all fit inside the clam-shelled compartments 14*a*, 14*b* to create a "boat in a box" that is easy to store, transport, and deploy.

For example, in selected embodiments, the completely clam-shelled compartments 14*a*, 14*b* may enable an eight foot boat 10 with outriggers to compact to a box that is about 32 inches high, 41 inches long, and 41 inches wide. This box can be transported inside an SUV and/or in the cargo area of some larger UTVs. The box may also easily fit within the bed of a pickup truck, while leaving plenty of room for other gear. The box may be sufficiently light that it can be carried by two people. The box may be easily stored within most any garage or carport.

In selected embodiments, one or more wheels may be embedded within or removably attached to the exterior of the completely clam-shelled compartments 14*a*, 14*b*. The wheel or wheels may enable one or more users to more easily move the box as desired or necessary.

Figure 9:
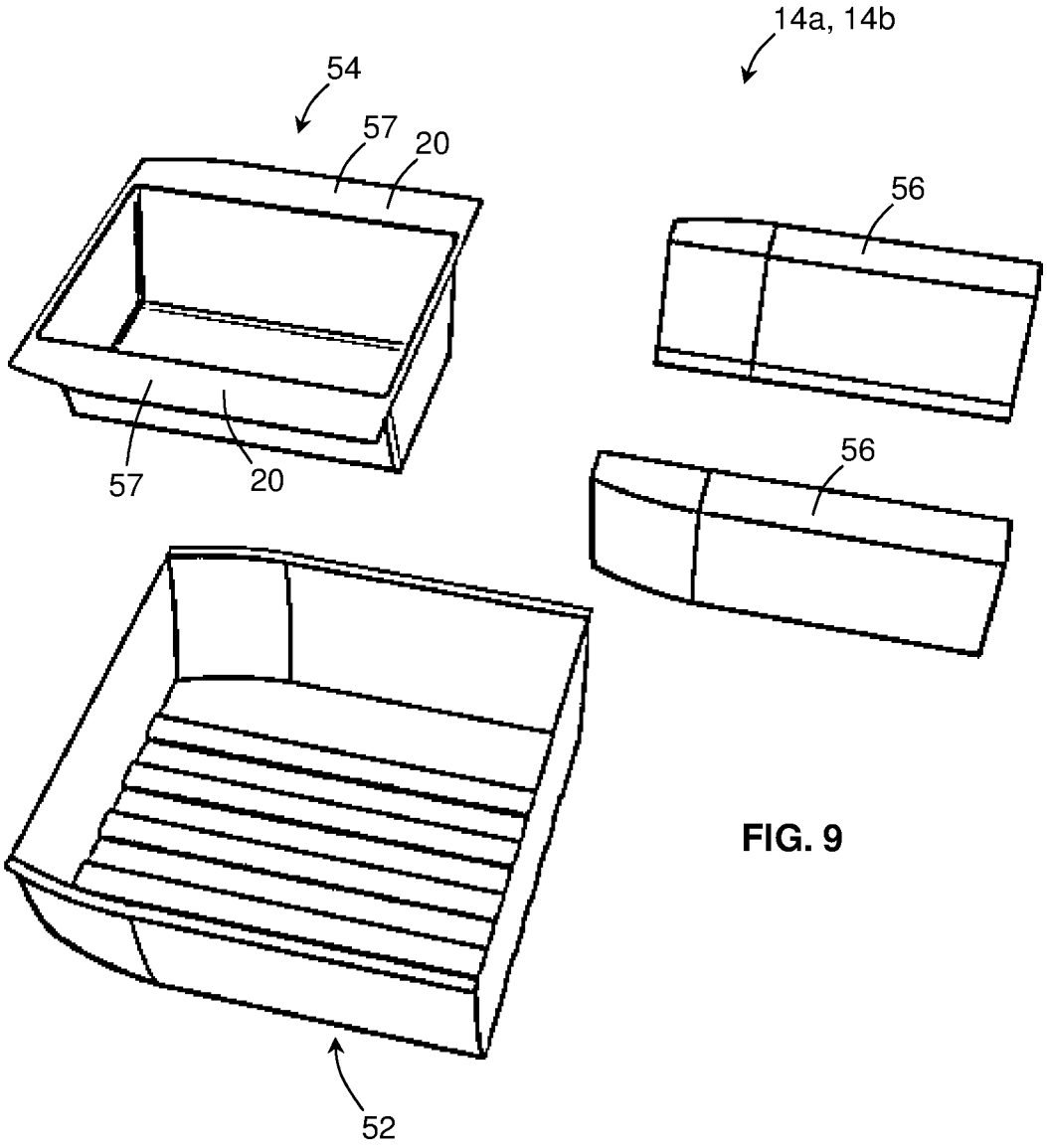
FIG. 9 is an exploded, perspective view of a passenger compartment of the boat of FIG. 1.

Referring to FIG. 9, in selected embodiments, the passenger compartments 14*a*, 14*b* of a boat 10 may each comprise an exterior shell 52 (e.g., an outer hull 52), an interior shell 54 (e.g., an inner hull 54), and one or more pieces of rigid foam 56 (e.g., closed cell polystyrene foam). The exterior shell 52 and interior shell 54 may be vacuum formed of ABS or other suitable polymeric material. An interior shell 54 may include wide sides 57 that provide top surfaces 20 suitable for seating.

When the passenger compartment 14*a*, 14*b* is assembled, the exterior and interior shells 52, 54 may be bonded together with the rigid foam 56 therebetween. The rigid foam 56 may provide flotation in the event that water was able to enter the space between the exterior and interior shells 52, 54. The rigid foam 56 may fill the spaces below the wide sides 57 of the interior shell 54.

In selected embodiments, spray foam (e.g., polyurethane foam) may be used to fill small gaps and/or bond the rigid foam 56 to corresponding adjacent interior surfaces of the exterior and/or interior shells 52, 54. Accordingly, the rigid foam 56 or the rigid foam 56 in combination with spray foam may give strength and support to the exterior and interior shells 52, 54, including the top surfaces 20 (thereby rendering the top surfaces 20 suitable for supporting the weight of one or more passengers). For example, in certain embodiments, rigid foam 56, spray foam, or some combination thereof may support and hold in place a duct that extends to connect an intake aperture 44 in the bottom of the compartment 14*a* to an exit aperture 46 in the back of the compartment 14*a*.

In selected embodiments, wood, metal, or other structural material may be positioned between the exterior and interior shells 52, 54 at certain locations where additional strength or rigidity is needed. For example, wood, metal, or the like may be bonded to the interior surfaces of the exterior and/or interior shells 52, 54 within the bulkheads 16*a*, 16*b* so as to provide a location or locations for securing hinges (e.g., hinges for connecting segments 14 together), securing one more outriggers components 28*a*, 28*b*, locking one segment 14 to a neighboring segment 14 so that they don't pivot with respect to one another, or the like. In certain embodiments, one or more strips of wood, metal, or the like may be bonded between the exterior and interior shells 52, 54 within one or more corrugations 22 in order to stiffen or strength a floor of a passenger compartment 14.

Figure 10:
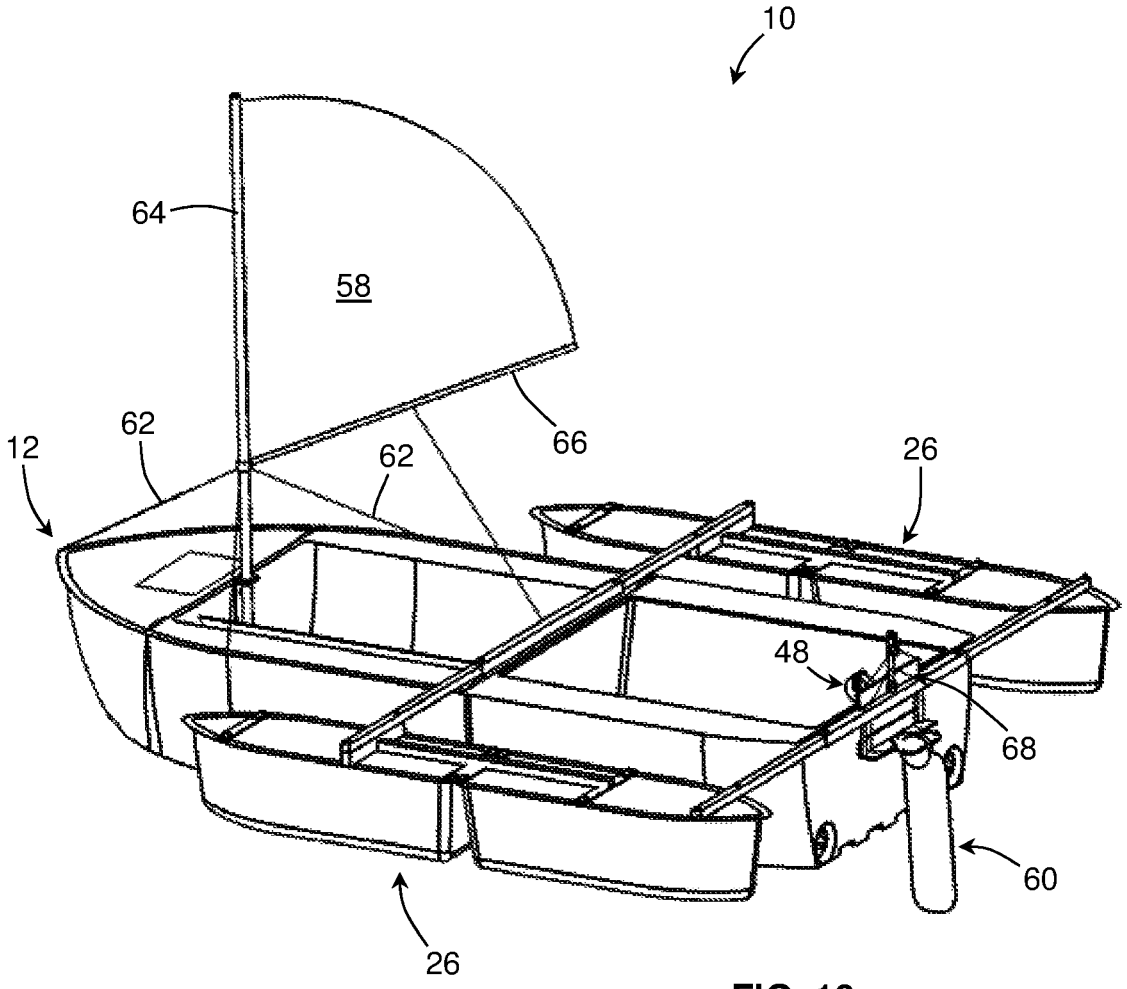
FIG. 10 is a perspective view of the boat of FIG. 1 in a deployed configuration and adapted to support sailing in accordance with the present invention.
Figure 11:
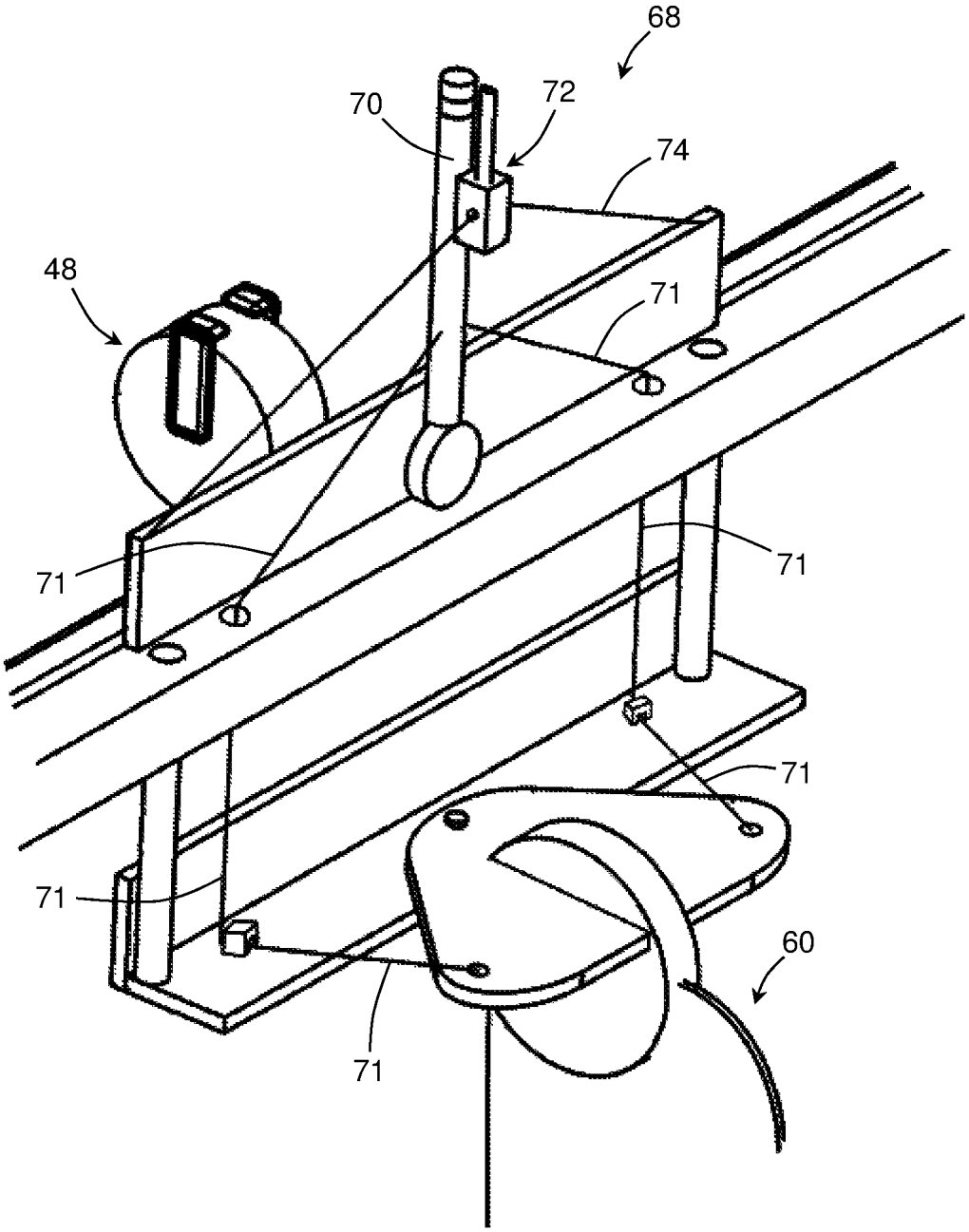
FIG. 11 is a close-up perspective view of the tiller mechanism shown in FIG. 10.
Figure 12:
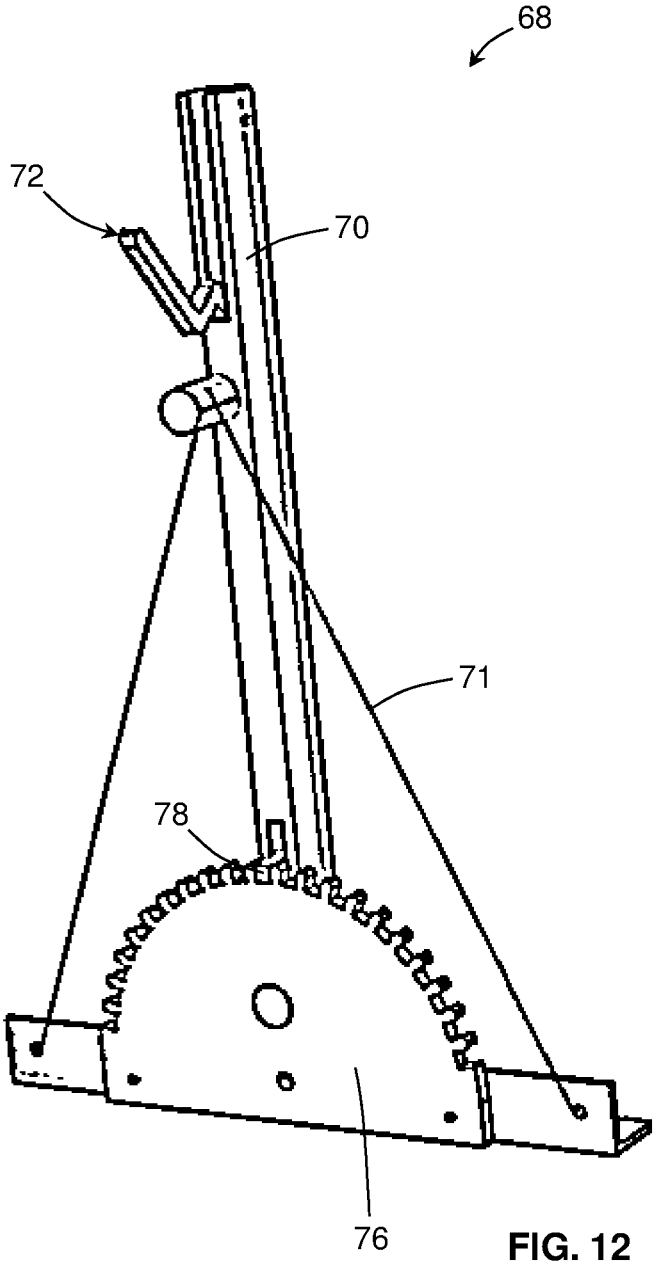
FIG. 12 is a perspective view of an alternative embodiment of a tiller mechanism in accordance of the present invention.

Referring to FIGS. 10-12, one or more pontoons 26 may provide the stability needed to enable the use of a sail 58 on a boat 10 that has no keel. Accordingly, in selected embodiments, a boat 10 in accordance with the present invention may include or be fitted with a sail 58 and rudder 60. Special attachment points may be included in the edges of the hull so that mast-support cords 62 may have suitable anchor points. The attachment points may pop up for connecting and drop down out of the way when the compartments 14*a*, 14*b* are closed. The mast 64 and boom 66 supporting the sail 58 may be made of carbon fiber and be configured to break apart into sections that fit, together with the sail 58, rudder 60, etc., inside a passenger compartment 14*a* when the boat 10 is stowed.

A rudder 60 may attach to the same support that holds various components of or forms the rear outrigger 28*b*. The rudder 60 may pivot up out of the way for shallow launching and drop down in deeper water. The rudder 60 may be free to pivot upward if it encounters an obstacle. The rudder 50 may also break into two parts for storage.

In selected embodiments, a boat 10 may include an upright tiller 68 controlling the position or orientation of the rudder 60. The upright tiller 68 may keep the tiller handle 70 outside of the boat 10. Through the use of connecting linkages, connecting cords 71, or the like, pivoting the tiller handle 70 to the starboard side of the boat 10 may cause the rudder 60 to steer the boat 10 to port. Conversely, pivoting the tiller handle 70 to the port side of the boat 10 may cause the rudder 60 to steer the boat 10 to starboard. The upright tiller 68 may use a special lever 72 to crimp onto a cord 74 to lock the tiller handle 70 in a desired position so that the user need not always hold the tiller handle 70.

Alternatively, a tiller system 68 may include a toothed element 76. In such embodiments, a lever 72 or the like may control movement of an engagement mechanism 78 that selectively engages and disengages the toothed element 76. For example, pulling a lever 72 may disengage an engagement mechanism 78 from the toothed element 76, thereby freeing a tiller handle 70 to move as desired. Once the tiller handle 70 is in the desired location, the lever 72 may be released and the engagement mechanism 78 may engage the toothed element 76 at that location and, thereby, lock the tiller handle 70 in the desired location.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of stowing a boat, the method comprising:

obtaining a boat in a deployed configuration comprising a first hull segment having a flat bottom with corrugations extending in a first direction, the first hull segment defining a first interior cavity having a first volume, a second hull segment having a flat bottom with corrugations extending in the first direction, the second hull segment defining a second interior cavity having a second volume, a third hull segment having a flat bottom with corrugations extending in the first direction, the third hull segment forming a bow of the boat, the first, second, and third hull segments being positioned with respect to one another such that the corrugations of the third hull segment align with the corrugations of the second hull segment and the corrugations of the second hull segment align with the corrugations of the first hull segment, a first securement mechanism connecting a front of the first hull segment to a back of the second full segment, and a second securement mechanism connecting the front of the second hull segment to a back of the third hull segment;

releasing the second securement mechanism;

separating the third hull segment from the second hull segment;

inverting one of the first hull segment and the second hull segment over onto the other such that the first hull segment and the second hull segment collectively form an enclosure having an interior volume comprising the first volume and the second volume;

capturing, with the inverting, the third hull segment within the interior volume of the enclosure.

2. The method of claim 1, wherein the boat further comprise a hinge pivotably connecting the front of the first hull segment to the back of the second full segment.

3. The method of claim 2, wherein the first hull segment and the second hull segment are, with respect to exterior dimensions, mirror images of one other across the hinge.

4. The method of claim 2, further comprising releasing the first securement mechanism.

5. The method of claim 4, wherein the inverting comprises pivoting, at the hinge, the first hull segment with respect to the second hull segment.

6. The method of claim 1, wherein the boat in the deployed configuration further comprises a first pontoon rigged and spaced outboard of a first side of the first hull segment.

7. The method of claim 6, wherein the boat in the deployed configuration further comprises a second pontoon rigged and spaced outboard of a second side of the first hull segment.

8. The method of claim 7, further comprising detaching the first pontoon and the second pontoon from the rest of the boat.

9. The method of claim 8, further comprising capturing, with the inverting, the first and second pontoons within the interior volume of the enclosure.

10. The method of claim 9, wherein the first pontoon comprises a forward segment and a rearward segment.

11. The method of claim 10, further comprising creating a nested assembly by nesting one of the forward segment and the rearward segment within the other.

12. The method of claim 11, further comprising placing, before the inverting, the nested assembly within one of the first interior cavity and the second interior cavity.

13. The method of claim 1, wherein the first hull segment comprises a first propulsion system and a second propulsion system.

14. The method of claim 13, wherein each of the first propulsion system and the second propulsion system comprises:

a duct extending from an opening in a bottom of the boat to an opening in a transom of the boat; and an electric, battery powered impeller positioned within the duct.

15. The method of claim 14, wherein neither the first propulsion system nor the second propulsion system extends below the bottom of the boat.

16. A method of stowing a boat, the method comprising:

obtaining a boat in a deployed configuration comprising a stern segment, an intermediate segment pivotably connected to the stern segment, a bow segment, a first pontoon comprising multiple hull segments rigged and spaced outboard of a first side of the stern segment, and a second pontoon comprising multiple hull segments rigged and spaced outboard of a second side of the stern segment;

separating the bow segment from the intermediate segment;

nesting one or more of the multiple hull segments of the first and second pontoons within one or more others of the multiple hull segments of the first and second pontoons;

pivoting one of the stern segment and the intermediate segment over onto the other such that the stern segment and the intermediate segment collectively form an enclosure; and capturing, with the pivoting, the bow segment and the multiple hull segments of the first and second pontoons within the enclosure.

17. The method of claim 16, further comprising detaching the first and second pontoons from the rest of the boat before the nesting, pivoting, and capturing.

18. A method of stowing a boat, the method comprising:

obtaining a boat in a deployed configuration comprising a stern segment having a flat bottom, an intermediate segment pivotably connected to the stern segment, the intermediate segment having a flat bottom, a bow segment having a flat bottom, a first pontoon comprising multiple hull segments rigged and spaced outboard of a first side of the stern segment, and a second pontoon comprising multiple hull segments rigged and spaced outboard of a second side of the stern segment;

separating the bow segment from the intermediate segment;

detaching the first and second pontoons from the rest of the boat;

nesting one or more of the multiple hull segments of the first and second pontoons within one or more others of the multiple hull segments of the first and second pontoons;

pivoting one of the stern segment and the intermediate segment over onto the other such that the stern segment and the intermediate segment collectively form an enclosure; and capturing, with the pivoting, the bow segment and the multiple hull segments of the first and second pontoons within the enclosure.

19. The method of claim 18, wherein the boat in the deployed configuration further comprises the stern, intermediate, and bow segments positioned with respect to one another such that the flat bottom of the bow segment is coplanar with the flat bottom of the intermediate segment and the flat bottom of the intermediate segment is coplanar with the flat bottom of the stern segment.

20. The method of claim 19, wherein:

the flat bottom of the stern segment has corrugations extending in a first direction;

the flat bottom of the intermediate segment has corrugations extending in the first direction;

the flat bottom of the intermediate segment has corrugations extending in the first directions; and the stern, intermediate, and bow segments are positioned with respect to one another such that the corrugations of the bow segment align with the corrugations of the intermediate segment and the corrugations of the intermediate segment align with the corrugations of the stern segment.

* * * * *